US006114844A

United States Patent [19]

Chang et al.

[11] Patent Number: 6,114,844

[45] Date of Patent: Sep. 5, 2000

[54] UNIVERSAL OUTPUT DRIVER AND FILTER

[75] Inventors: Menping Chang, Cupertino; Vuong K. Le, Milpitas, both of Calif.

[73] Assignee: Kendin Communications, Inc., Sunnyvale, Calif.

[21] Appl. No.: 09/321,983

[22] Filed: May 28, 1999

[51] Int. Cl.[7] ..... G05F 1/40

[52] U.S. Cl. ..... 323/281; 323/315; 323/313

[58] Field of Search ..... 323/315, 273, 323/275, 281, 311, 312, 313, 314, 349, 282, 83

[56] References Cited

U.S. PATENT DOCUMENTS

| | | | |
|---|---|---|---|
| 5,267,269 | 11/1993 | Shih et al. | 375/60 |
| 5,291,123 | 3/1994 | Brown | 323/369 |
| 5,878,082 | 3/1999 | Kishigami | 375/257 |

OTHER PUBLICATIONS

Orsatti, Piazza, Huang, and Morimoto, "A 20 mA–receive 55 mA–transmit GSM transceiver in .25/spl mu/m CMOS", IEEE, pp. 232–233, Feb. 1999.

Johnson, Mark G, et al. "A Variable Delay Line PLL for CPU —Coprocessor Synchronization" Oct. 1988, pp. 1218–1223, *IEEE Journal of Solid–State Circuits*, vol. 23 No. 5.

Sonntag, Jeff, et al. "A Monolithic CMOS 10 MHz DPLL for Burst–Mode Data Retiming", Feb. 16, 1990, pp. 194–195 and 294, 1990 IEEE International Solid–State Circuits Conference Digest of Technical Papers, 37$^{th}$ ISSCC, First Edition.

Everitt, James, et al., "A CMOS Transceiver for 10–Mb/s and 100–Mb/s Ethernet", Dec. 1998, pp. 2169–2177, *IEEE Journal of Solid–State Circuits*, vol. 33, No. 12.

*Primary Examiner*—Peter S. Wong
*Assistant Examiner*—Gary L. Laxton
*Attorney, Agent, or Firm*—Fenwick & West LLP

[57] ABSTRACT

An output driver is provided with driving and filtering capability. An output current driver and output voltage driver embodiments are provided. The output current driver includes, an operational amplifier having a first input for receiving a first input voltage $V_1$, a second input for receiving a second input voltage $V_2$, and an output for generating an output voltage Vc. The output current driver also includes a transistor having an input terminal coupled to the output of the operational amplifier for receiving the output voltage Vc, a first terminal coupled to a differential pair, and a second terminal coupled to the second input of the operational amplifier, wherein an output current $I_{out}$ flows across the transistor. A control current $I_{CONTROL}$ determines a value of the first input voltage $V_1$, while the output voltage Vc controls the transistor so that the second voltage $V_2$ becomes equal to the first voltage $V_1$. The voltage driver includes, a first plurality of parallel modules coupled to an output load and capable of setting a first equivalent resistive value and a second equivalent resistive value, and a second plurality of parallel modules coupled to the output load and capable of setting a third equivalent resistive value and a fourth equivalent resistive value. At least some of the equivalent resistive values determine an output voltage value across the output load.

14 Claims, 9 Drawing Sheets

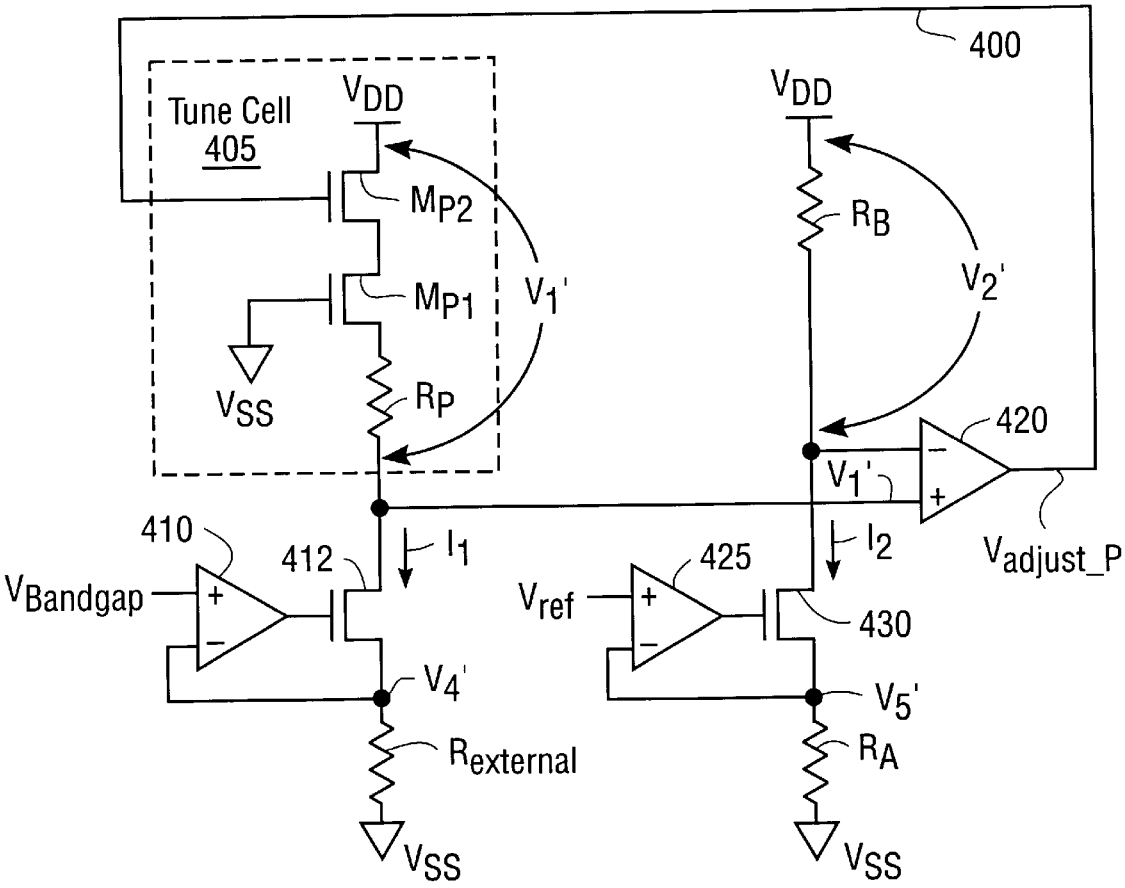
FIG. 8 Tune Circuit (P-Channel)
$$V_{ref} = \frac{R_Y}{R_X + R_Y} \cdot V_{DD} - (R_X \| R_Y) \cdot \frac{V_{Bandgap}}{R_Z}$$
$$V_{ref} = aV_{DD} - bV_{Bandgap}$$
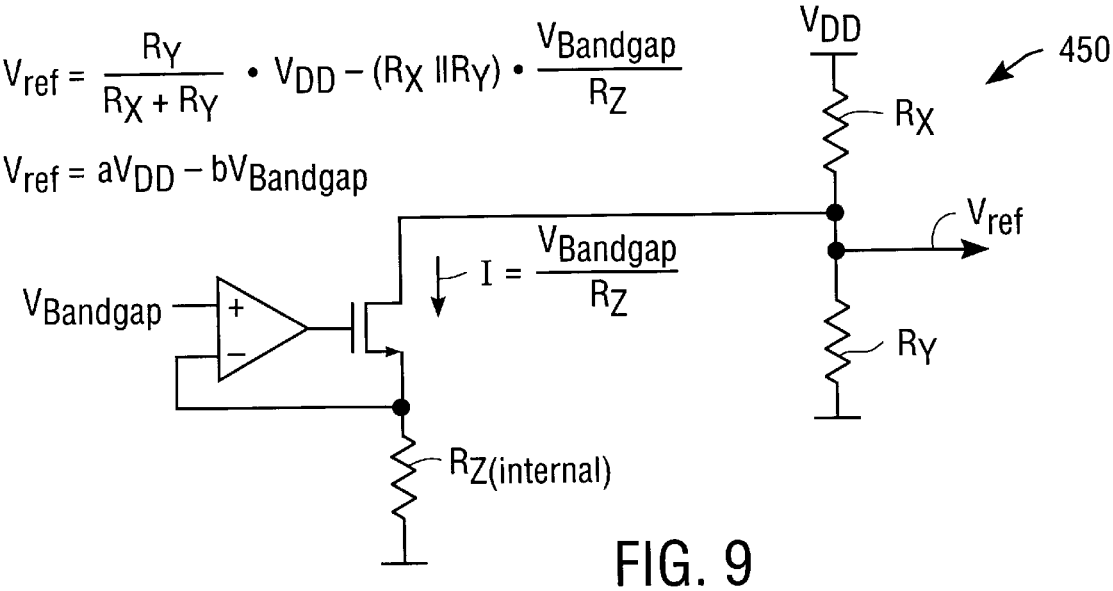
FIG. 9

$I_1 = V_{Bandgap}/R_{external}$ $I_2 = V_{ref}/R_A$

Tune Circuit (N-Channel)

UNIVERSAL OUTPUT DRIVER AND FILTER

CROSS-REFERENCE TO RELATED APPLICATION

The subject matter of this application is related to the subject matter of the following co-pending U.S. Applications: (1) U.S. application Ser. No. 09/322,668, filed May 28, 1999 by Jung-Chen Lin, entitled "A DELAY LOCKED LOOP FOR SUB-MICRON SINGLE-POLY DIGITAL CMOS PROCESSES" which is fully incorporated herein by reference; (2) U.S. application Ser. No. 09/321,903, filed May 28, 1999 by Menping Chang and Hai T. Nguyen, entitled "ADAPTIVE EQUALIZER AND METHOD" which is fully incorporated herein by reference; (3) U.S. application Ser. No. 09/321,938, filed May 28, 1999 by Menping Chang and Hai T. Nguyen, entitled "SELECTIVE SAMPLED PEAK DETECTOR AND METHOD" which is fully incorporated herein by reference; and (4) U.S. application Ser. No. 09/322,247, filed May 28, 1999 by Hai T. Nguyen and Menping Chang, entitled "BASELINE WANDER COMPENSATION CIRCUIT AND METHOD" which is fully incorporated herein by reference.

FIELD OF THE INVENTION

The present invention relates generally to the field of line communications and more particularly to a line driver with waveform-shaping capability.

BACKGROUND OF THE INVENTION

In the line communications environment, line drivers are key components for interfacing with and driving signals along a communications line. It is important to filter or shape the output waveform of a line driver to minimize the amount of frequency interference to satisfy FCC requirements or other regulations and/or the specification set by the manufacturer. Waveform-shaping techniques are performed in the time domain, while waveform filtering is performed in the frequency domain.

In one conventional approach, an external filter is coupled to the driver output. However, this conventional approach increases the cost due to the filter component.

In another conventional approach, on-chip filtering is used but requires a near-unity gain analog output buffer to preserve the internally-filtered waveform and to drive the waveform along a communications line. Thus, this conventional approach also requires the additional output buffer that leads to a die size increase and to additional power requirements. As data transmission rates increase to 100 megahertz or greater, suitable analog output buffers with wide bandwidth and high driving capability become extremely difficult to design and too costly to implement (due to increased power and die size requirements).

Therefore, there is a need for an improved output driver that overcomes the foregoing deficiencies and that could operate under low power and be implemented in a much smaller die size. The present invention achieves the above advantages by merging the filter function into the driver stage.

SUMMARY OF THE INVENTION

The present invention provides an apparatus and method for integrating the functions of driving and filtering signals on a communication line over a wide band of signal frequencies. In one aspect of the present invention, an output current driver includes, an operational amplifier having a first input for receiving a first input voltage $V_1$, a second input for receiving a second input voltage $V_2$, and an output for generating an output voltage Vc. The output driver also includes a transistor having an input terminal coupled to the output of the operational amplifier for receiving the output voltage Vc, a first terminal coupled to a differential pair, and a second terminal coupled to the second input of the operational amplifier, wherein an output current $I_{out}$ flows across the transistor. A control current $I_{CONTROL}$ determines a value of the first input voltage $V_1$, while the output voltage Vc controls the transistor so that the second voltage $V_2$ becomes equal to the first voltage $V_1$.

In another aspect of the present invention, a voltage driver includes, a first plurality of parallel modules coupled to an output load and capable of setting a first equivalent resistive value and a second equivalent resistive value. The voltage driver further includes a second plurality of parallel modules coupled to the output load and capable of setting a third equivalent resistive value and a fourth equivalent resistive value, wherein at least some of the equivalent resistive values determine an output voltage value across the output load.

The present invention provides output drivers (voltage drive and current drive) that deliver both accurate (voltage/current) output drive and precision filter performance. With an on-chip-tracking scheme, the output driver of the present invention is insensitive to fabrication process, supply voltage, and temperature variations. The present invention is very suitable for low supply voltage operation. The output voltage driver embodiment utilizes the whole supply voltage range, while the output current driver embodiment has low voltage swing limited to a drain-to-source voltage, $V_{DS\,(saturation)}$, above ground and can support a high voltage swing to rise above the supply rail provided with external pull up current. These drivers can be segmented to incorporate a multi-phase design that improves filter resolution without requiring an increase in clock rate. The segment on/off control sequence follows the algorithm of FIR (finite impulse response) filter that is well proven and readily available. The present invention is useful in various applications such as line drivers, transceivers, modems and other data communication devices.

BRIEF DESCRIPTION OF THE DRAWINGS

FIG. 8 is a schematic circuit diagram of an embodiment of a tuning circuit for generating the $V_{adjust_P}$ control signal;

FIG. 9 is a schematic circuit diagram of an embodiment of a circuit for generating the $V_{ref}$ control signal;

DETAILED DESCRIPTION OF THE PREFERRED EMBODIMENTS

One embodiment of a line driver in accordance with the present invention includes a current-output driver. Another embodiment of the present invention includes a voltage-output driver. As also discussed below in further detail, a multi-phase filtering technique and an output level control technique may be applied to either of the current-drive or voltage-drive embodiments of the present invention.

Current Output Driver

Figure 1:
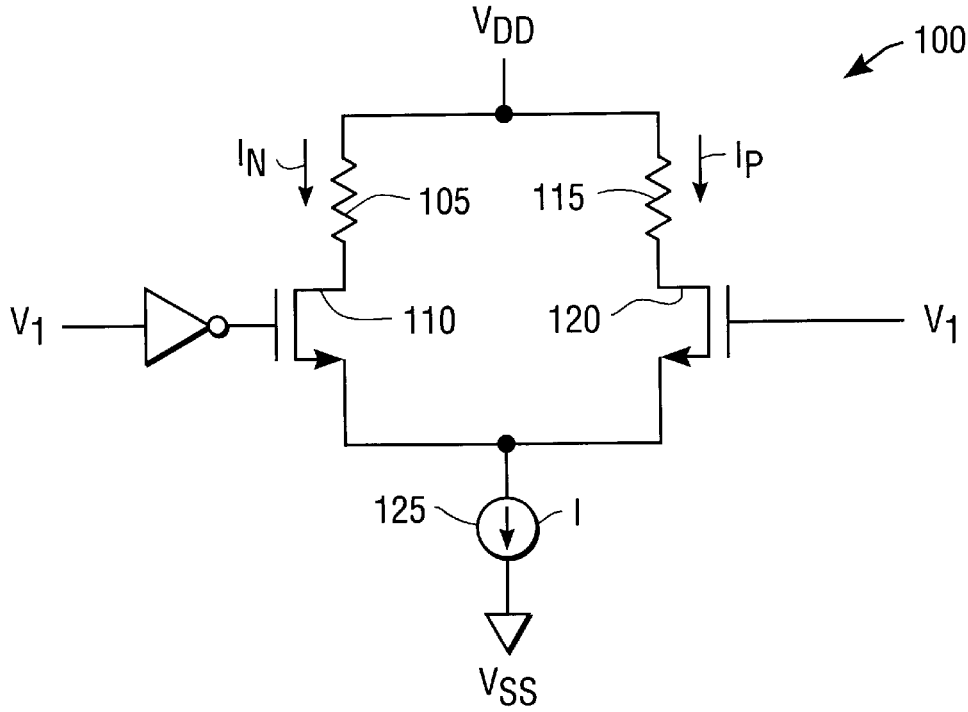
FIG. 1 is a schematic circuit diagram of a differential pair including a current source.

FIG. 1 is a schematic circuit diagram of a differential pair 100 that can implement the present invention and that can be used as an element of a current output driver. Two load resistors 105 and 115 are connected between the external power supply $V_{DD}$ and transistors 110 and 120, respectively. The application of a control voltage $V_1$ at the gate input of transistor 120 and its complement at the gate input of transistor 110 can either turn on transistor 120 and turn off transistor 110, or vice versa. The control voltage $V_1$, therefore, directs current to one of the load transistors (e.g., load transistor 105) and prevents current from flowing in the other load transistor (e.g., load transistor 120), thereby permitting the development of an output signal. If, for example, transistor 110 is on and transistor 120 is off, (this is referred as differential pair ON in the following description, since $I_N$ is the current of focus in the below example), then $I_N$=I and $I_P$=0, wherein I is the current value provided by current source 125.

Figure 2:
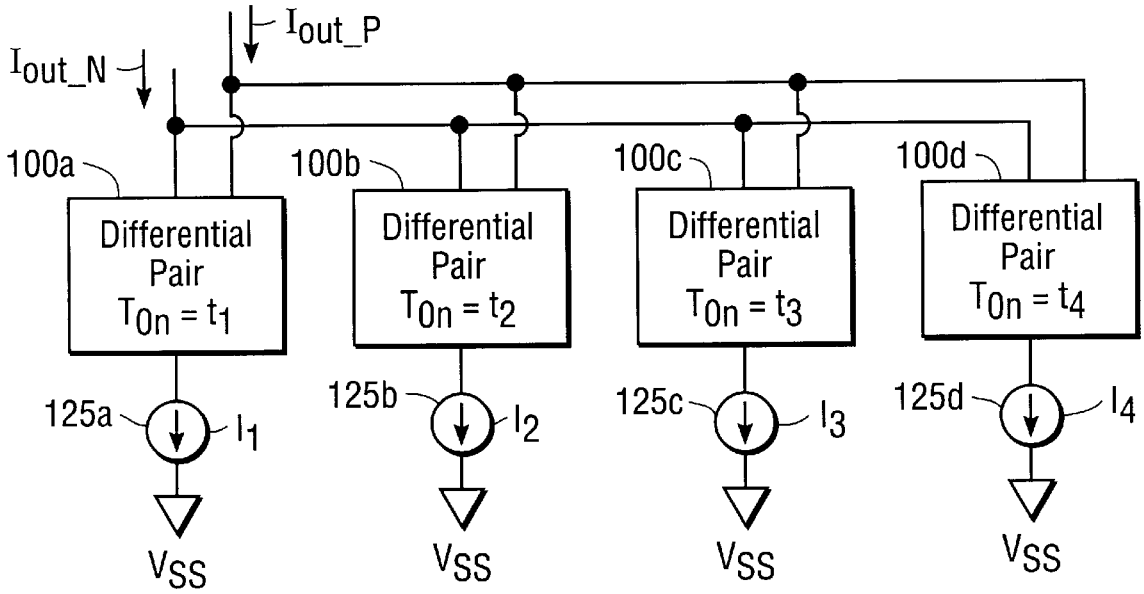
FIG. 2 is a schematic block diagram of multiple differential pairs coupled together for generating a current-driven output waveform.
Figure 3:
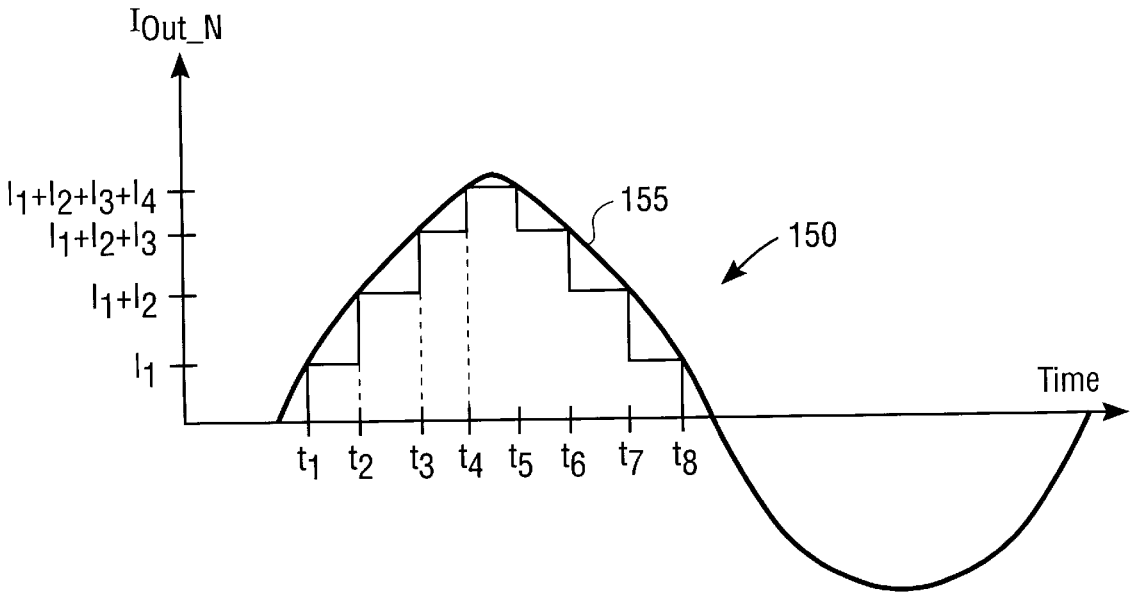
FIG. 3 is a waveform diagram of a signal generated by the differential pairs configuration of FIG. 2.

Reference is now made to the block diagram of FIG. 2 and the waveform diagram of FIG. 3. A plurality of differential pairs 100*a*–100*d* can generate the output waveform 150, which is partially shown in FIG. 3. At time $t_1$, the output current $I_{out_N}$ will have a value of $I_1$, since the differential pair 100*a* turns on. At time $t_2$, the differential pair 100*b* turns on, while the differential pair 100*a* remains on. As a result, $I_{out_N}$ will have a value equal to $I_1+I_2$. At time $t_3$, the differential pair 100*c* turns on, while at time $t_4$, the differential pair 100*d* turns on. At time $t_3$, $I_{out_N}=I_1+I_2+I_3$, while at time $t_4$, $I_{out_N}=I_1+I_2+I_3+I_4$. At time $t_5$, the differential pair 100*d,* for example, turns off so that $I_{out_N}=I_1+I_2+I_3$. A particular differential pair will turn off at subsequent_time $t_6$ to $t_8$ so that $I_{out_N}$ approximates a pulse-like shape from time $t_1$, to time $t_8$. If the time interval, for example $\Delta t=t_2-t_1$, is small enough, the smoothed-curve 155 may be derived to form a controlled waveform. It is further noted that selected ones of the current sources 125*a*–125*d* may be weighted in a conventional manner to achieve a more flexible filter response. Additionally, the number of differential pairs shown in FIG. 2 may be varied.

Figure 4:
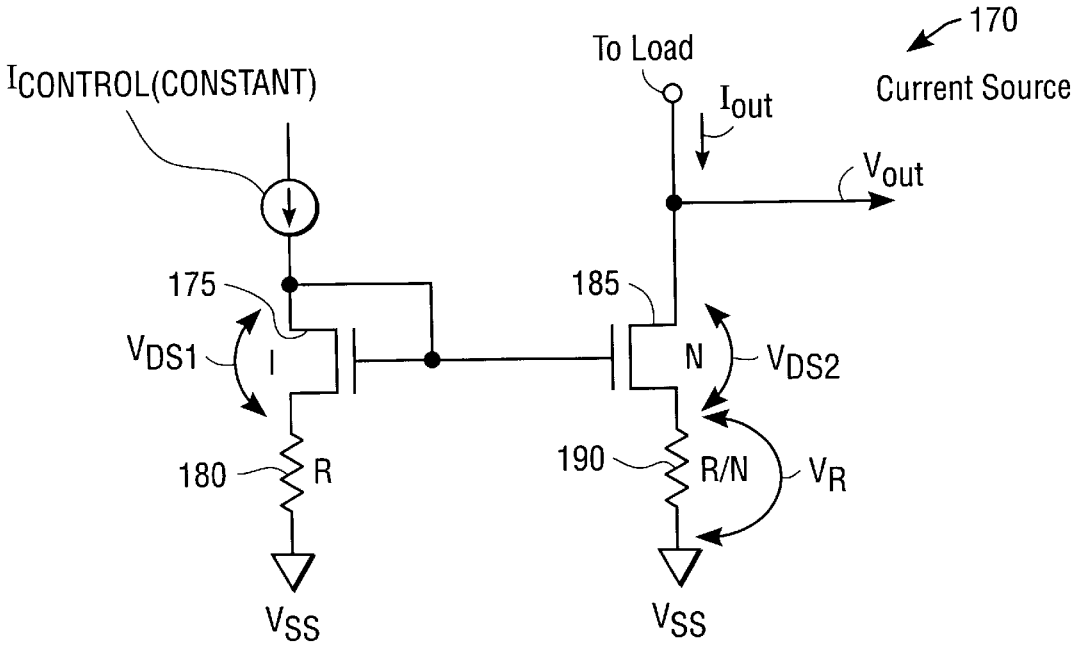
FIG. 4 (PRIOR ART)
FIG. 4 is a schematic diagram of a conventional circuit that can implement each of the current source 125*a* to 125*d* of FIG. 2.

FIG. 4 shows a conventional scheme to implement a current source. A current mirror 170 is used to implement any of the current sources 125*a*–125*d* of FIG. 2. The conventional current mirror 170 includes a transistor 175 and a resistor 180 coupled between the transistor 175 and ground. The resistor 180 has a resistive value of R. The current mirror 170 also includes a transistor 185, which has N times the size of transistor 175; and a resistor 190 coupled between transistor 185 and ground. The size of transistor resistor 190 has a resistive value of R/N; with N being a scaling factor chosen so that $I_{out}=(N)(I_{control(CONSTANT)})$. However, the conventional current mirror 170 of FIG. 4 relies entirely on device matching to control the output current $I_{out}$. As a result, the conventional current mirror 170 is an open loop approach, and has no control over the effect caused by a difference in $V_{DS1}$ and $V_{DS2}$ (which are the drain-to-source voltage values of transistors 175 and 185, respectively). This is a very severe limitation for sub-micron fabrication processes, which has a strong short channel effect. This means the output voltage $V_{out}$ can change the $V_{DS2}$ value and, therefore, $V_{out}$ affects the output current $I_{out}$. In other words, the output impedance of the conventional current mirror 170 is rather small. Resistors 180 and 190 can be used to improve the output impedance. However, the resistor values have to be greater than (1/gm) to be effective. The term gm is the transconductance of NMOS transistor 175. Since the transconductance (gm) of a CMOS transistor is rather small, this characteristic requires a relatively large resistive value for resistors 180 and 190. The voltage drop ($V_R$) across resistor 190 is, therefore, also large, and disadvantageously limits the available voltage swing that the current source 170 can deliver.

In conclusion, the conventional current mirror 170 of FIG. 4 requires more "floor room" (i.e., minimum voltage above ground required for the circuit to operate properly) to operate. In addition, the conventional current mirror 170 has an output impedance which is low and an output current which is poorly controlled.

Figure 5:
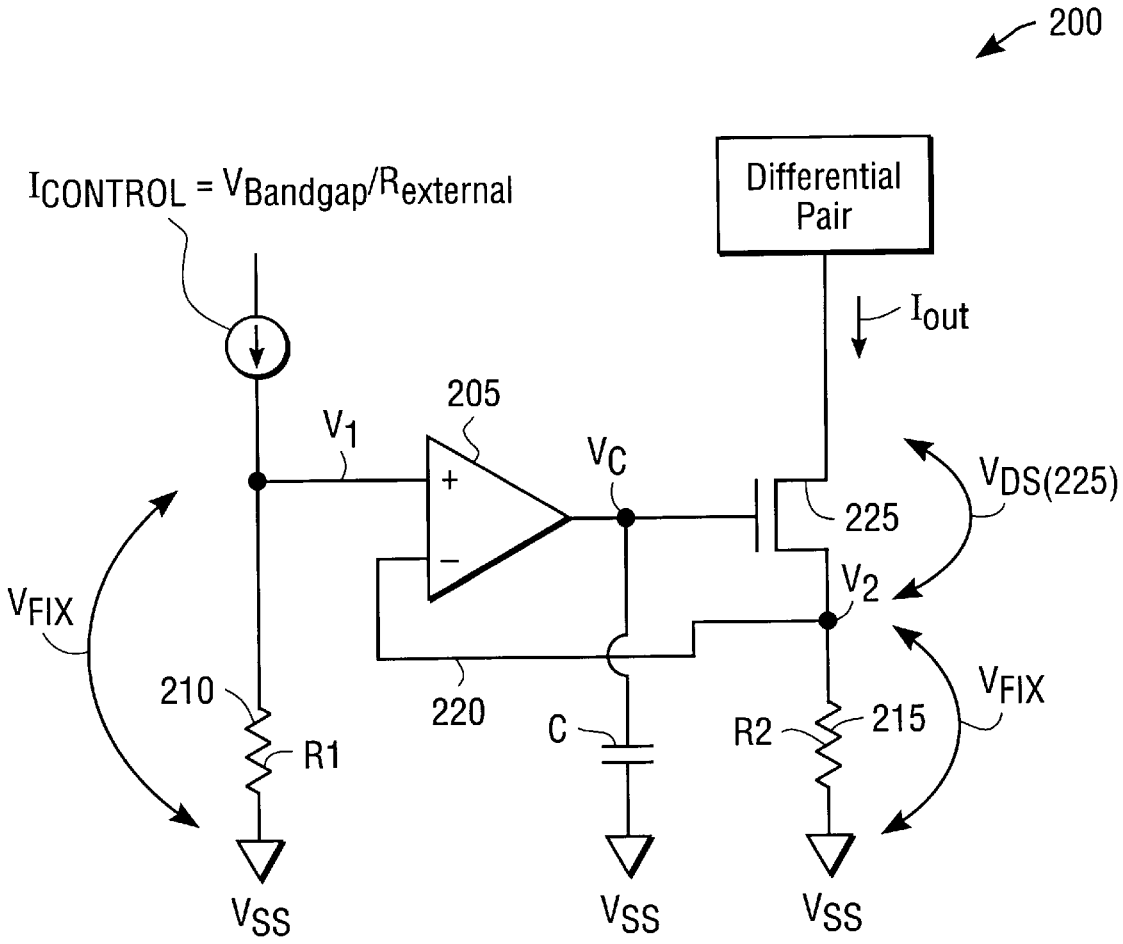
FIG. 5 is a schematic circuit diagram of an output current driver in accordance with an embodiment of the present invention.

FIG. 5 illustrates a circuit diagram of a current source 200 in accordance with an embodiment of the present invention. The current source 200 includes an operational amplifier 205 which receives an input voltage $V_1$ at a positive terminal "+", an input voltage $V_2$ at a negative terminal "−", and which outputs an output voltage Vc. A control current $I_{CONTROL}$ determines the voltage across a resistor 210 to set the voltage $V_1$ value. The current $I_{out}$ determines the voltage across a resistor 215 to set the $V_2$ value. Based upon the feedback path 220, the high gain operational amplifier 205 outputs a voltage Vc value to control the transistor 225 so that $V_1=V_2$. A capacitor C is used to compensate the operational amplifier 205 for good stability and also serves to reduce the coupling noise injected into Vc due to differential pair switching.

The feedback path 220 forces the voltage $V_2$ to equal the voltage $V_1$ as shown in equation (1).

$$V_1=V_2=V_{FIX}=(I_{CONTROL})(R1)=(I_{out})R2 \quad (1)$$

The parameter R1 is the resistive value of resistor 210, while the parameter R2 is the resistive value of resistor 215. Equation (2) can be derived from equation (1).

$$I_{out}=(I_{CONTROL})(R1/R2) \quad (2)$$

As a result, the output current $I_{out}$ is controlled by setting the ratio R1/R2 to the desired value. Unlike conventional approaches, the current driver 200 permits the $I_{out}$ value to be independent of the drain-to-source voltage ($V_{DS(225)}$) across transistor 225. This is because the output impedance of the current source 200 is greatly enhanced by the presence of the operational amplifier 205. Additionally, unlike the voltage $V_R$ of the conventional current mirror 170 of FIG. 4, the voltage levels of $V_1$, $V_2$, and $V_{FIX}$ ($V_1=V_2=V_{FIX}$) have no constraints. Therefore, a lower voltage value may advantageously be used to reduce floor room for low voltage operations by the current source 200.

It is further noted that $I_{CONTROL}$ is determined by equation (3).

$$I_{CONTROL}=V_{Bandgap}/R_{external} \quad (3)$$

The term $V_{Bandgap}$ is an internal reference voltage value, and it is nearly independent of process, temperature and supply voltage variations if properly designed. The term $R_{external}$ is a resistive value set by a precision external resistor. Thus, $I_{CONTROL}$, as well as, $I_{out}$ are independent of the process, temperature, and supply voltage variations.

The present invention provides a well-controlled, process independent current source 200. The multiple differential pairs (such as elements 100*a* to 100*d* in FIG. 2) may each be implemented with the current source 200 and turned on and off to deliver the desire output current. Furthermore, the precision filtering is performed if the on/off switching of these differential pairs follow a digitally controlled sequence. By controlling the time interval of current activation and the current weighting factor in the differential pairs, a universal filter can be incorporated into a current driver of the present invention.

Voltage Output Driver

Figure 6:
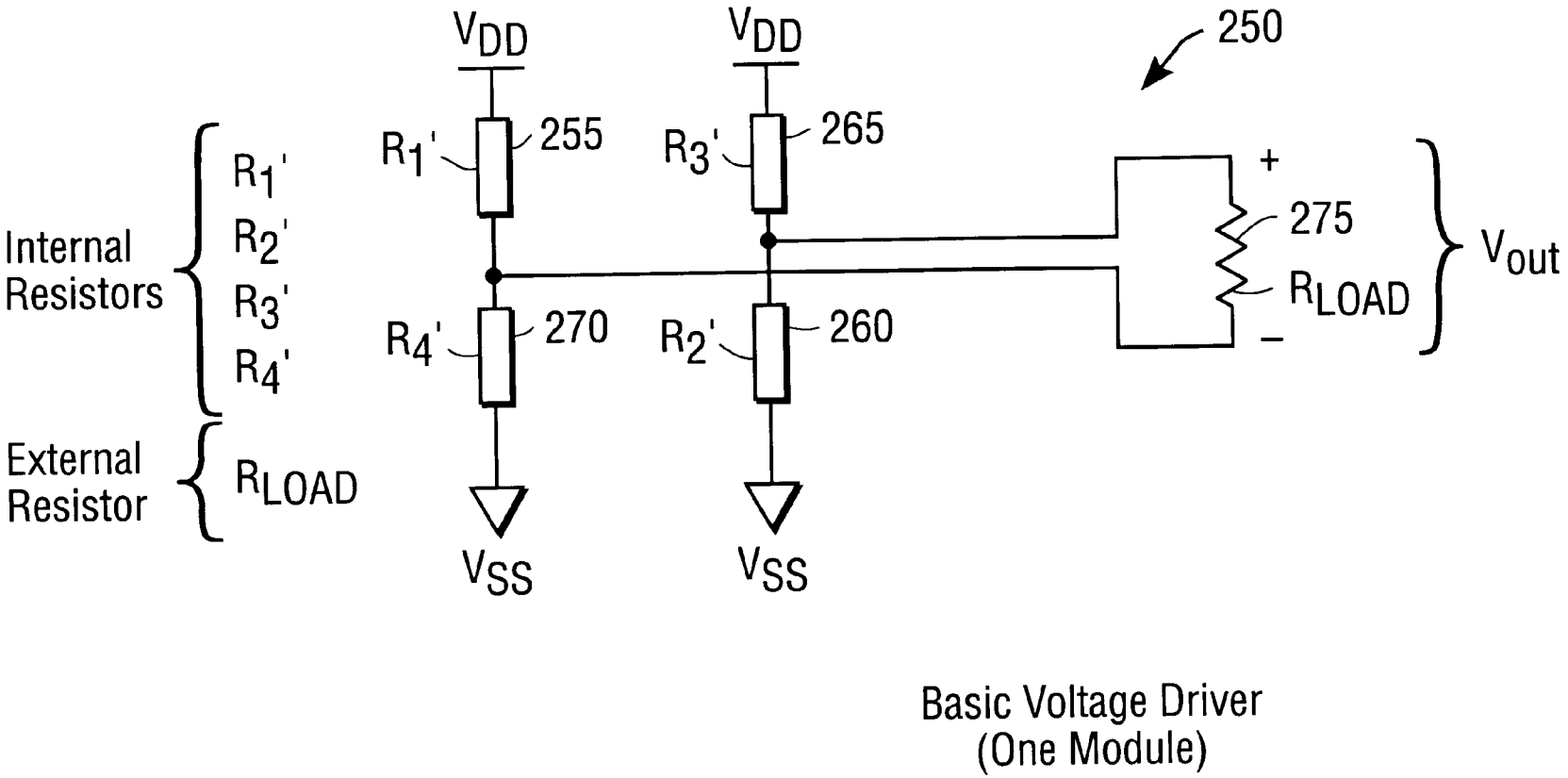
FIG. 6 is a schematic block diagram of an output voltage driver in accordance with an embodiment of the present invention.

FIG. 6 is a schematic block diagram of a voltage driver 250 in accordance with an embodiment of the present invention. The voltage driver 250 is based on a voltage divider structure and is symmetrical. There are four (4) variables in this embodiment, namely $R_1'$, $R_2'$, $R_3'$, and $R_4'$. Because only one (1) variable is required to generate the voltage output, this structure is very flexible by controlling the other variables to address other design issues such as maintaining a constant common voltage, constant current consumption, etc. As an illustration, the example shown here is to achieve minimum current consumption and to maintain a constant common mode voltage. This translates to the following: if $V_{out}>0$, then $R_1'$, $R_2'$ are on and $R_3'$, $R_4'$ are off, and $R_1'=R_2'$; if $V_{out}<0$, then $R_1'$, $R_2'$ are off and $R_3'$, $R_4'$ are on, and $R_3'=R_4'$. When any of the resistors $R_1'$ to $R_4'$ turn off, then the off resistor is equivalently an open circuit, i. e., the resistor value approaches an infinite value.

Table 1 shows the resistor elements and corresponding resistance values in the voltage driver 250 of FIG. 6.

TABLE 1

| resistor element | | resistance value |
|---|---|---|
| 255 | $R_1'$ | (total equivalent P-channel output resistance) |
| 260 | $R_2'$ | (total equivalent N-channel output resistance) |
| 265 | $R_3'$ | (total equivalent P-channel output resistance) |
| 270 | $R_4'$ | (total equivalent N-channel output resistance) |
| 275 | $R_{LOAD}$ | (equivalent output load resistance) |

For a positive output voltage $V_{out}$ value, equation (4) is applicable.

$$V_{out}=R_{LOAD}*V_{DD}/(R_1'+R_2'+R_{LOAD}) \quad (4)$$

The term $V_{DD}$ is the supply voltage value. It is further noted that the resistance values $R_3'$ and $R_4'$ control a negative value of $V_{out}$.

Figure 7A:
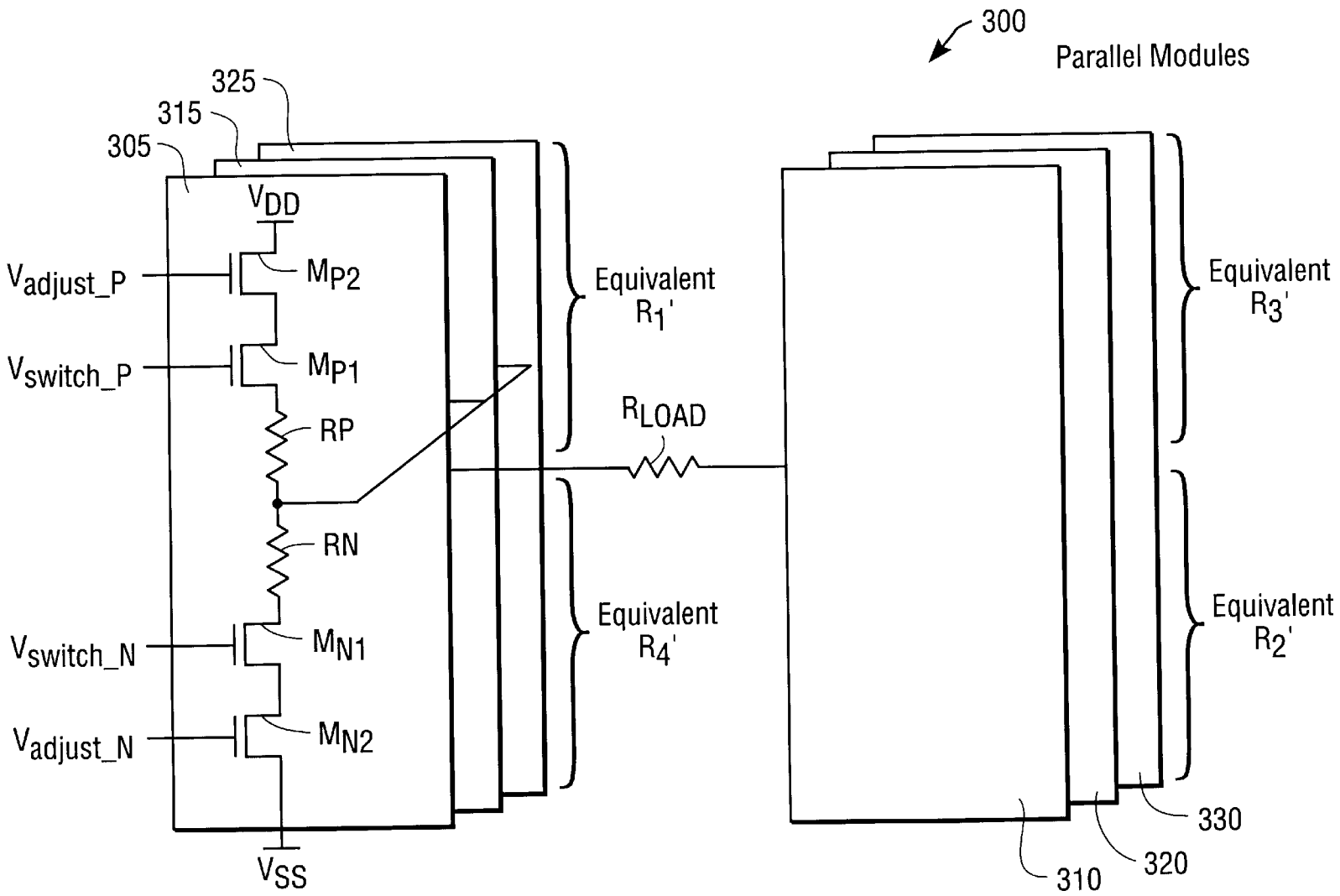
FIG. 7A is a schematic block diagram of a modularized voltage driver in accordance with an embodiment of the present invention.

FIG. 7A is a block diagram of a general-purpose modularized output voltage driver 300 in accordance with an embodiment of the present invention. The output voltage driver 300 is formed by modules 305–330. Although only three (3) modules are shown on each side of the load resistor $R_{LOAD}$ in FIG. 7A, the number of modules is variable. The modules 305–330 are identical to each other in structure but may be scaled for the weighting factor. The combined effect of modules 305, 315, 325 is to implement $R_1'$ and $R_4'$, while modules 310, 320, 330 implement $R_2'$ and $R_3'$.

Inside each module (e.g., module 305), there are P portion and N portion. The P portion includes a switch $M_{P1}$ for turning on/off its associated branch and its equivalent resistor $R_P$, as well as switch $M_{P2}$ which servers as an adjustable resistor for tuning purposes. Similarly, the N portion includes a switch $M_{N1}$, switch $M_{N2}$, and resistor $R_N$. During $V_{out}>0$, a switch $M_{N2}$ in each of the modules 305, 315 and 325 are turned off and a switch $M_{P2}$ in each of the modules 310, 320, and 330 are off. As a result $R_3'$, $R_4'$ are off (open circuit). A switch $M_{P2}$ in each of the modules 305, 315 and 325, and a switch $M_{N2}$ in each of the modules 310, 320, and 330 are turned on/off sequentially to control the output voltage $V_{out}$. In the case of turning on the switches $M_{P2}$ and $M_{N2}$, the values of $R_1'$ and $R_2'$ reduce due to more parallel devices and $V_{out}$ increases. In the case of turning off the switches $M_{P2}$ and $M_{N2}$, the values of $R_1'$ and $R_2'$ increase due to less parallel devices, and $V_{out}$ is reduced. For $V_{out}<0$, a switch $M_{P2}$ in each of the modules 305, 315 and 325 are turned off and $M_{N2}$ in each of the modules 310, 320, and 330 are off. As a result, the resistors $R_1'$, $R_2'$ are off (open circuit). A switch $M_{N2}$ in each of the modules 305, 315 and 325, and a switch $M_{P2}$ of the modules 310, 320, and 330 are turned on/off sequentially.

Figure 7B:
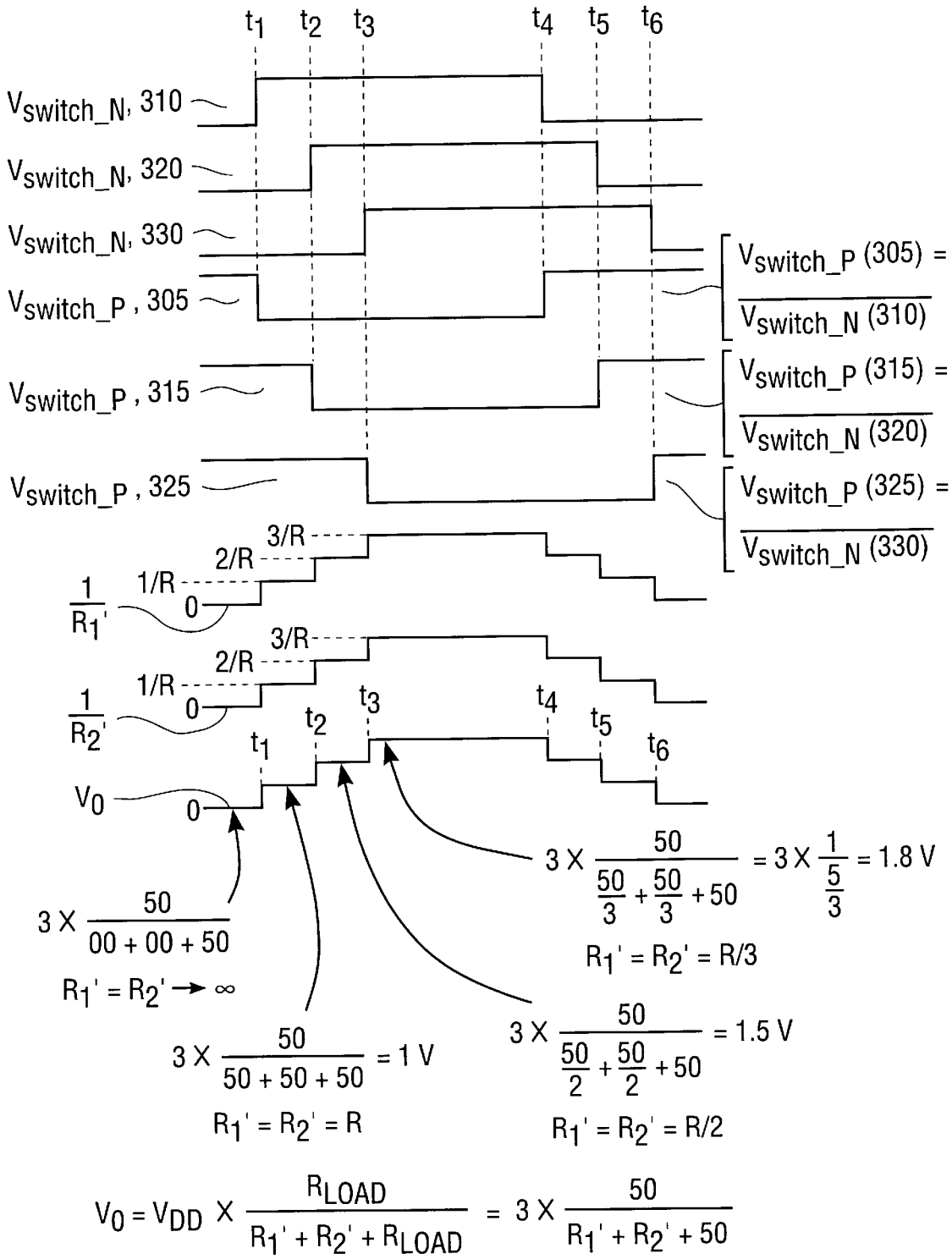
FIG. 7B is a waveform diagram illustrating the switching and effect of the signals $V_{switch_P}$ and $V_{switch_N}$.

Reference is now made to the schematic block diagram of FIG. 7A and to the waveform diagram of FIG. 7B to further discuss the operation of the modularized output voltage driver 300. As an example, the following are assumed: $V_{DD}$=3.0 volts, $R_{LOAD}$=50.0 ohms, and $R_P=R_N$=50 ohms. Initially, the $V_{switch_P}$ signal (received by modules 305, 315 and 325) is high, and as a result, the transistors $M_{P1}$ (in each of the modules 305, 315 and 325) are off and $R_1'\rightarrow\infty$ and $1/R_1'=0$. Also, the $V_{switch_N}$ signal (received by modules 310, 320, 330) is low, and as a result, transistors $M_{N1}$ (in each of the modules 310, 320, and 330) are off and $R_2'\rightarrow\infty$ and $1/R_2'=0$. Therefore, $V_0=(V_{DD})(R_{LOAD})/(R_1'+R_2'+R_{LOAD})=50/(\infty+50)\rightarrow 0$.

At time t1, the $V_{switch_P}$ signal (for module 305) is low and turns on a transistor $M_{P1}$ in module 305. The $V_{switch_N}$ signal (for module 310) is high and turns on a transistor $M_{N1}$ in module 310. Therefore, $R_1'=R_P$ and $R_2'=R_N$, and $V_0=(V_{DD})(R_{LOAD})/(R_1'+R_2'+R_{LOAD})=(3)(50)/(50+50+50)=1.0$ volt (see FIG. 7B).

At time t2, the $V_{switch_P}$ signals (for modules 305 and 315) are low and turn on transistors $M_{P1}$ in modules 305 and 315. The $V_{switch_N}$ signals (for module 310 and 320) are high and turn on transistors $M_{N1}$ in module 310 and 320. Therefore, $R_1'=R_P/2$, since the resistors $R_P$ of modules 305 and 315 are in parallel ($1/R_1'=2/R_P$). Also, $R_2'=R_N/2$ since the resistors $R_N$ of modules 310 and 320 are in parallel ($1/R_2'=2/R_N$). As a result, $V_0=(V_{DD})(R_{LOAD})/(R_1'+R_2'+R_{LOAD})=(3)(50)/(50/2+50/2+50)=1.5$ volt (see FIG. 7B).

At time t3, the $V_{switch_P}$ signals (for modules 305, 315 and 325) are low and turn on transistors $M_{P1}$ in modules 305, 315, and 325. The $V_{switch_N}$ signals (for modules 310, 320, and 330) are high and turn on transistors $M_{N1}$ in module 310, 320, and 330. Therefore, $R_1'=R_P/3$, since the resistors $R_P$ of modules 305, 315, and 325 are in parallel ($1/R_1'=3/R_P$). Also, $R_2'=R_N/3$, since the resistors $R_N$ of modules 310, 320, and 330 are in parallel ($1/R_2'=3/R_N$). As a result, $V_0=(V_{DD})(R_{LOAD})/(R_1'+R_2'+R_{LOAD})=(3)(50)/(50/3+50/3+50)=1.8$ volt (see FIG. 7B).

At time t4, t5, and t6, the parallel modules in FIG. 7A are turned off sequentially. Thus, the resistance values of $R_1'$ and $R_2'$ increase and the value of the voltage $V_0$ decreases sequentially. For example, the following sequence may occur: time t4, $V_0$=1.8v; time t5, $V_0$=1.5v; time t6, $V_0$=1.0v.

Figure 10:
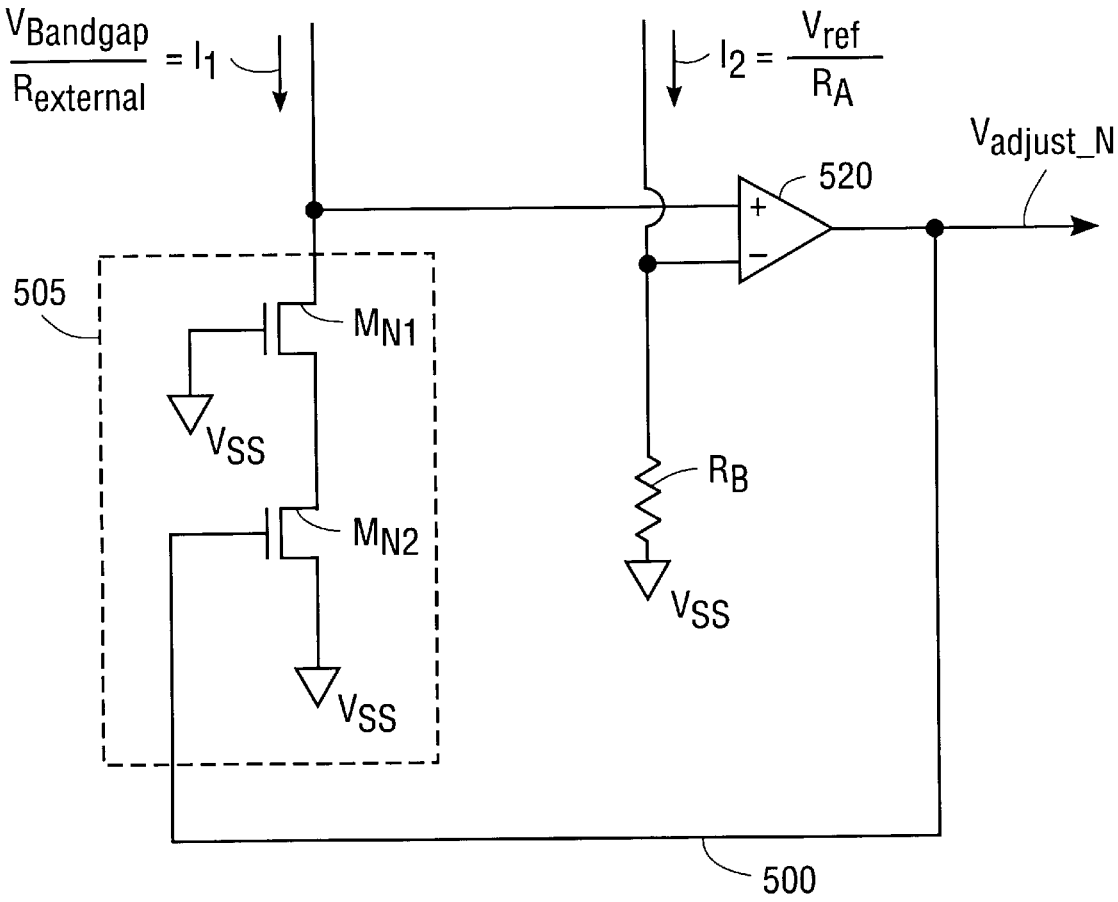
FIG. 10 is a schematic circuit diagram of an embodiment of a tuning circuit for generating the $V_{adjust_N}$ control signal.

The switches $M_{P1}$ and $M_{N1}$ serve as switching devices for a module. The transistors $M_{P2}$ and $M_{N2}$ serve as tuning devices for a module to maintain a precision voltage output level over process, temperature, and supply voltage changes. FIG. 8 shows a detailed implementation of the tuning circuit for generating the $V_{adjust_P}$ control signal to adjust the equivalent P-channel output resistance (e.g., one segment of resistance $R_1'$). A separate tuning circuit, as shown in FIG. 10, is used to generate the $V_{adjust_N}$ control signal for adjusting the equivalent N-channel output resistance (e.g., one segment of resistance $R_3'$). All modules in FIG. 7A share the same $V_{adjust_P}$ and $V_{adjust_N}$ control signals, but with individual control of $V_{switch_P}$ and $V_{switch_N}$.

In FIG. 8, a replica of the P-channel half of the modularized cell 305 (FIG. 7A) is used for tuning. The transistor $M_{P1}$ is tied to ground to represent an "on" condition, while the transistor $M_{P2}$ is controlled through a feedback path 400. The purpose of this feedback path 400 is to lock the equivalent P resistor to an external resistor to achieve insensitivity to process and temperature variations. The current value $I_1$ is set by $V_{Bandgap}/R_{external}$ and flows into a tune cell 405 (formed by $M_{P1}$, $M_{P2}$, and $R_P$). As a result, the current value $I_1$ develops a voltage value $V_1'$. An operational amplifier 410 together with a transistor 412 enforce the following condition as expressed in equations (5) and (6):

$$V_{Bandgap}=(I_1)(R_{external}), \tag{5}$$

$$I_1=V_{Bandgap}/R_{external} \tag{6}$$

Similar operation of an operational amplifier 425 and a transistor 430 set the current source $I_2=V_{ref}/R_A$. This $I_2$ flows into a resistor $R_B$ and sets up voltage $V_2'$. The operational amplifier 425, with transistor $M_{P2}$ of tune cell 405, sets the $V_{adjust_P}$ control signal along the feedback adjustment loop 400. The $V_{adjust_P}$ control signal is generated by the operational amplifier 420 to adjust the transistor $M_{P2}$ so that $V_1$ becomes equal to $V_2$. Reference is first made to the $V_2$ value as expressed in equation (7) in which Rtune is the resistive value of tune circuit 405.

$$V_1=(I_1)(R\text{tune})=(V_{Bandgap}/R_{external})(R\text{tune}) \tag{7}$$

Equation (8) expresses the $V_2$ value.

$$V_2=(I_2)\times(R_B)=(V_{ref}/R_A)(R_B) \tag{8}$$

If $V_1=V_2$, then equations (9) and (10) can be derived.

$$V_1=V_2=(V_{Bandgap}/R_{external})\times(R\text{tune})=(V_{ref}/R_A)(R_B) \tag{9}$$

$$R\text{tune}=(V_{ref}/V_{Bandgap})(R_B/R_A)(R_{external}) \tag{10}$$

The term $R_{external}$ is the resistive value of an external resistor, which is independent of process and temperature variations. The terms $R_A$ and $R_B$ are internal resistor values. Since the terms $R_A$ and $R_B$ are affected equally by process and temperature variations, a constant ratio ($R_A/R_B$) is the result. The term Rtune is, therefore, proportional to the external resistor $R_{external}$ if $V_{ref}$ has the same characteristic of $V_{Bandgap}$. It is noted further that this Rtune is the P equivalent resistor of the module 305. The $R_1'$ in FIG. 6 is the equivalent resistance of all the parallel P portion of module 305, 315, and 325.

However, based on equation (4) above, even Rtune is locked to a constant external resistor. The net output voltage is still a function of the supply voltage $V_{DD}$ variation. To cancel the $V_{DD}$ variation on Rtune, the $V_{ref}$ term of equation (10) is modified. The circuit 450 of FIG. 9 permits an output voltage $V_{ref}$ to be based on Equation (11).

$$V_{ref}=(R_Y)(V_{DD})/(R_X+R_Y)-[(R_X)(R_Y)/(R_X+R_Y)]\times V_{Bandgap}/R_Z \tag{11}$$

Equation (11) can be simplified into equation (12) since resistor $R_X$, $R_Y$, and $R_Z$ have the same characteristic over process, temperature, and $V_{DD}$.

$$V_{ref}=(a)(V_{DD})-(b)(V_{Bandgap}) \tag{12}$$

The terms a and b are constants that are independent of process, temperature, and $V_{DD}$. By substitution of the $V_{ref}$ term in Equation (12), the Rtune equation of equation (10) may now be expressed as shown in equation (13).

$$R\text{tune}=[(a)(V_{DD})-(b)(V_{Bandgap})]/(V_{Bandgap})(R_B)(R_{external}/R_A)=\alpha(V_{DD})-\beta \tag{13}$$

The terms α and β can be expressed in equations 14A and 14B, respectively.

$$\alpha=a/V_{Bandgap}*(R_B/R_A)*R_{external} \tag{14A}$$

$$\beta=b*(R_B/R_A)*R_{external} \tag{14B}$$

As described before, both the terms α and β are insensitive to process, temperature and $V_{DD}$ variations. Therefore, in equation (13), the term Rtune is independent of the process and temperature variations, but is a function of the supply voltage $V_{DD}$. With this tuning, $R_1'$ can be expressed by equation (15), while $R_2'$ can be expressed by equation (16).

$$R_1'=\alpha 1*V_{DD}-\beta 1, \tag{15}$$

$$R_2'=\alpha 2*V_{DD}-\beta 2 \tag{16}$$

As a result, $V_{out}$ in equation (4) may be re-written as shown in Equations (17) and (18).

$$V_{out}=R_{LOAD}/[\alpha 1*V_{DD}-\beta 1+\alpha 2*V_{DD}-\beta 2+R_{LOAD}]*V_{DD}=R_{LOAD}/[(\alpha 1+\alpha 2)*V_{DD}-(\beta 1+\beta 2)+R_{LOAD}]*V_{DD} \tag{17}$$

$$V_{out}=R_{LOAD}/[\alpha 1+\alpha 2];\ \text{if}\ (\beta 1+\beta 2)=R_{LOAD} \tag{18}$$

Therefore (β1+β2) may be chosen to cancel the $V_{DD}$ effect. Notice that (β1+β2) is a term that is proportional to an external resistor and has the same characteristic as $R_{LOAD}$.

FIG. 10 shows the tuning scheme for the N half of a module in FIG. 7A. Following the same operation as its P counter part, the operational amplifier 520 sets up the adjustment loop 500 and $V_{adjust_N}$ to tune the transistor $M_{N2}$. The switch $M_{N1}$ is connected to $V_{DD}$ to represent an on condition. Because this loop shares the same $V_{Bandgap}$, $R_{external}$, and $V_{ref}$ as the P-channel tune circuit of FIG. 8, the net result of Rtune is the same. Therefore $R_2'$ has the same value as $R_1'$ as a previously stated goal. For an application that does not require $R_1'=R_2'$, the ratio ($R_B/R_A$) can be set differently in the two tuning circuits.

This invention presents a well-controlled voltage driver and the $V_{out}$ swing is set by turning on/off the number of segment of each module of FIG. 7A. The precision filtering is performed by having these modules follow a digitally controlled on/off sequence. By controlling the time interval and the weighting factor (the size of $M_{P1}$, $M_{P2}$, $M_{N1}$, $M_{N2}$, $R_P$ and $R_N$ in each branch), a universal filter can be incorporated into a voltage driver in accordance with the present invention. Additionally, two above-described tuning circuits are employed to maintain a constant $V_{out}$ that is independent of process, temperature and supply voltage variations.

Multiple-Phase Filtering

Figure 11:
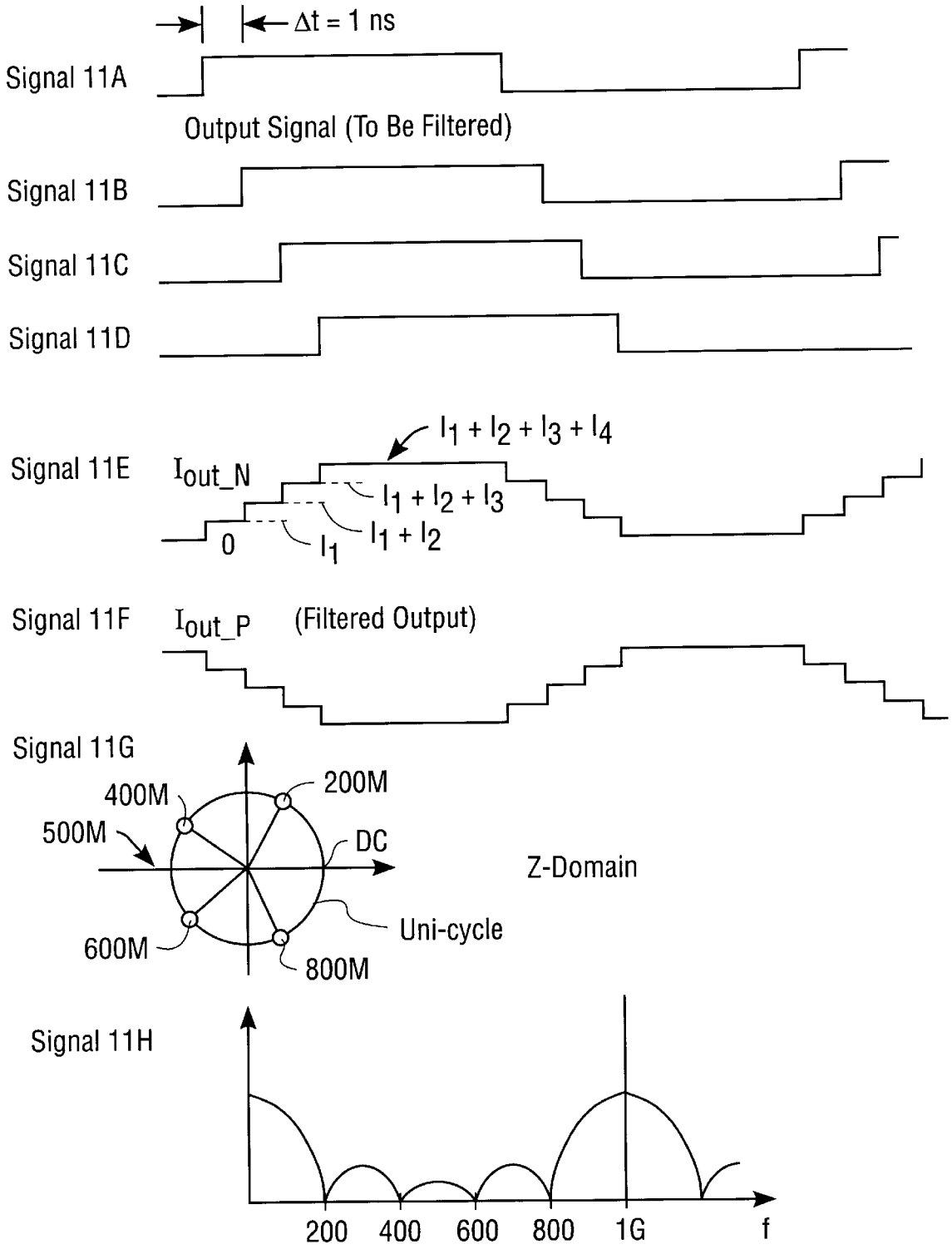
FIG. 11 are waveform diagrams that illustrate the multi-phase operation and the filtered output of an output driver in accordance with an embodiment of the present invention.

As dictated by the FIR filter theory, the sampling rate f=1/Δt is one of key parameters to determine the filter performance. It is important to point out that it is the Δt that actually matters, not the frequency. Therefore, a control delay implementation (e.g., Δt=1 nano-second) is better suited than a high clock rate approach (e.g., f=1/Δt=1 GHz). To illustrate this effect, assume that the circuit in FIG. 2 has the following control waveforms shown in FIG. 11, so that signal 11A is, for example, voltage V1 for controlling differential pair 100 (FIG. 1) or 100*a* (FIG. 2). The signal 11A is the output signal that requires filtering. The signals 11B, 11C, and 11D are the delayed versions of signal 11A, separated each by 1 ns delay (Δt=1 ns). The signals 11A, 11B, 11C, and 11D control the module 100*a*, 100*b*, 100*c*, and 100*d*, respectively. The corresponding filtered output current $I_{out_N}$ and $I_{out_P}$ (FIG. 2) are shown as signals 11E and 11F in FIG. 11. The position of the zeros in z-domain is shown in diagram 11*g* of FIG. 11 and the frequency response is shown in diagram 11*h* of FIG. 11. The digital output signal 11A after the filter driver has the current output as well as a controlled slope, with 0%–100% rise/fall time equals to approximately 4.0 nano-seconds. Reduced slope is the key for harmonic reduction. Even though waveform is not as smooth in the time domain due to the limited step, the frequency response of the filter is well behaved. In a data communication system, because they are mostly digital based, the unwanted spurious and harmonics are usually concentrated and predictable (at the multiples of data rate). Therefore, selectively placing the zeros (as shown in diagram 11*g* of FIG. 11) at those location can achieve a better performance. It is noted further that each of the signals 11A–11D may serve as a Vswitch_P signal for an associated transistor MP1 in a module of FIG. 300.

Because the present invention uses modularize cells, the invention fits very well for the multi-phase control and has very little circuit overhead. The multi-phase control delay method of the present invention can achieve the same filter performance without using a high frequency clock, which is noisy, and consumes more power.

Overall the present invention delivers well controlled current and voltage output levels over process, temperature, and supply voltage variations. The present invention also has wider operating range and provides a flexible filter design using modularized cell. The present invention has a low circuit overhead for switch controls by use of the controlled delay multiple phases approach and exhibits power and die size advantages. The present invention combines the merits of driving capability and filtering in a flexible and well-controlled way.

What is claimed is:

1. An output driver with driving and filtering capability, comprising:

an operational amplifier having a first input for receiving a first input voltage ($V_1$), a second input for receiving a second input voltage ($V_2$), and an output for generating an output voltage (Vc); and a transistor having an input terminal coupled to the output of the operational amplifier for receiving the output voltage (Vc), a first terminal coupled to a differential pair, and a second terminal coupled to the second input of the operational amplifier, wherein an output current ($I_{out}$) flows across the transistor;

a first resistor coupled to the first input of the operational amplifier and having a first resistive value;

a control current source coupled to the first resistor and to the first input of the operational amplifier and configured to provide a variable control current ($I_{CONTROL}$);

a second resistor coupled to the second input of the operational amplifier and the second terminal of the transistor and having a second resistive value;

wherein a value of the output current ($I_{out}$) is determined by the first resistive value, the second resistive value and the variable control current ($I_{CONTROL}$);

wherein the variable control current ($I_{CONTROL}$) is a variable value that is dependent on an internal reference voltage value ($V_{Bandgap}$) and a variable resistive value ($R_{external}$), and wherein the variable control current ($I_{CONTROL}$) is substantially independent of process, temperature, and supply voltage variations;

wherein the variable control current ($I_{CONTROL}$) determines a value of the first input voltage ($V_1$);

wherein the output voltage (Vc) controls the transistor so that the second voltage ($V_2$) becomes equal to the first voltage ($V_1$).

2. The output driver of claim 1 wherein the internal reference voltage value ($V_{Bandgap}$) is independent of process, temperature and supply voltage variations.

3. The output driver of claim 1 further comprising:

an output capacitor coupled to the output of the operational amplifier and capable of reducing a coupling noise that is injected into the output voltage (Vc).

4. The output driver of claim 1 wherein the input voltages ($V_1$) and ($V_2$) are independent from constraints and may be set to lower values to permit low voltage operation for the output driver.

5. The output driver of claim 1 wherein additional output drivers are coupled to the output driver, each of the additional output drivers coupled to an associated differential pair.

6. The output driver of claim 5 wherein each associated differential pair coupled to an output driver are switched on and off in a digitally controlled sequence to control an output current of each differential pair and provide a filtered current output.

7. The output driver of claim 6 wherein an output current of each differential pair is set by a current weighting factor.

8. A circuit for providing a filtered current output, comprising:

a plurality of differential pair coupled together to generate the filtered current output;

each of the differential pair including an associated current driver comprising:

an operational amplifier having a first input for receiving a first input voltage ($V_1$), a second input for receiving a second input voltage ($V_2$), and an output for generating an output voltage (Vc); and a transistor having an input terminal coupled to the output of the operational amplifier for receiving the output voltage (Vc), a first terminal coupled to a differential pair, and a second terminal coupled to the second input of the operational amplifier, wherein an output current ($I_{out}$) flows across the transistor;

wherein a control current ($I_{CONTROL}$) determines a value of the first input voltage ($V_1$);

wherein the output voltage (Vc) controls the transistor so that the second voltage ($V_2$) becomes equal to the first voltage ($V_1$).

9. The circuit of claim 8 wherein an associated current driver further comprises:

a first resistor coupled to the first input of the operational amplifier and having a first resistive value; and a second resistor coupled to the second input of the operational amplifier and the second terminal of the transistor and having a second resistive value;

wherein a value of the output current ($I_{out}$) is determined by the first resistive value, the second resistive value and the control current ($I_{CONTROL}$).

10. The output driver of claim 9 wherein the control current ($I_{CONTROL}$) is determined by an internal reference voltage value ($V_{Bandgap}$) that is independent of process, temperature and supply voltage variations and by an external resistor value ($R_{external}$).

11. A method of generating an output current from a current driver, comprising:

providing a variable control current value that is dependent on an internal reference voltage value and an adjustable resistive value, the variable control current value being substantially independent of process, temperature, and supply voltage variations;

receiving a first input voltage value and a second input voltage value, the first input voltage value being determined by the variable control current value;

generating an output voltage value based upon a comparison of the first input voltage value and the second input voltage value; and adjusting the output voltage value so that the second input voltage value approaches the value of the first input voltage value.

12. An output driver with driving and filtering capability, comprising:

an operational amplifier having a first input for receiving a first input voltage $V_1$, a second input for receiving a second input voltage $V_2$, and an output for generating an output voltage Vc; and a transistor having an input terminal coupled to the output of the operational amplifier for receiving the output voltage Vc, a first terminal coupled to a differential pair, and a second terminal coupled to the second input of the operational amplifier, wherein an output current $I_{out}$ flows across the transistor;

wherein a control current $I_{CONTROL}$ determines a value of the first input voltage $V_1$;

wherein the output voltage Vc controls the transistor so that the second voltage $V_2$ becomes equal to the first voltage $V_1$; and wherein additional output drivers are coupled to the output driver, each of the additional output drivers coupled to an associated differential pair.

13. The output driver of claim 12 wherein each associated differential pair coupled to an output driver are switched on and off in a digitally controlled sequence to control an output current of each differential pair and provide a filtered current output.

14. The output driver of claim 13 wherein an output current of each differential pair is set by a current weighting factor.

* * * * *